US011512855B2

(12) United States Patent
Cadima

(10) Patent No.: US 11,512,855 B2
(45) **Date of Patent: *Nov. 29, 2022**

(54) COOKTOP APPLIANCE AND HEATING ELEMENT HAVING A THERMALLY ISOLATED THERMOSTAT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/932,920

(22) Filed: Jul. 20, 2020

(65) Prior Publication Data

US 2022/0018545 A1 Jan. 20, 2022

(51) Int. Cl.

| | |
|---|---|
| ***F24C 7/08*** | (2006.01) |
| ***F24C 15/36*** | (2006.01) |
| ***H05B 3/76*** | (2006.01) |
| *H05B 1/02* | (2006.01) |

(52) U.S. Cl.

CPC ..... *F24C 7/088* (2013.01); *F24C 15/36* (2013.01); *H05B 3/76* (2013.01); *H05B 1/0213* (2013.01)

(58) Field of Classification Search

CPC ..... F24C 7/067; F24C 7/088; F24C 15/101; F24C 15/102; F24C 15/105; F24C 15/106; F24C 15/108; F24C 15/36; H05B 3/68; H05B 3/72; H05B 3/746; H05B 3/748; H05B 3/76; H05B 1/0208; H05B 1/0213; H05B 1/0219; H05B 1/0266

USPC ..... 219/443.1–468.2

See application file for complete search history.

(56) References Cited

U.S. PATENT DOCUMENTS

| | | | | |
|---|---|---|---|---|
| 3,041,437 A * | 6/1962 | Carissimi | ..... | H05B 1/0213 219/448.16 |
| 4,241,289 A * | 12/1980 | Bowling | ..... | F24C 15/105 219/448.14 |
| 6,246,033 B1 | 6/2001 | Shah | | |
| 2018/0238559 A1 | 8/2018 | Campeol | | |

FOREIGN PATENT DOCUMENTS

| | | |
|---|---|---|
| CN | 205697127 U | 11/2016 |
| JP | 06017498 B2 | 11/2016 |

* cited by examiner

*Primary Examiner* — Hung D Nguyen

(74) *Attorney, Agent, or Firm* — Dority & Manning, P.A.

(57) ABSTRACT

A cooktop appliance or electric resistance heating coil assembly, as provided herein, may include a shroud cover, a thermostat, and a heat transfer disk. The shroud cover may define an axial hole. The thermostat may be positioned radially inward from the shroud cover. A continuous circumferential thermal break may be defined as a radial gap within the axial hole between the thermostat and the shroud cover. The heat transfer disk may be attached to the thermostat at the distal end of the thermostat and extend radially outward above the shroud cover.

20 Claims, 7 Drawing Sheets

COOKTOP APPLIANCE AND HEATING ELEMENT HAVING A THERMALLY ISOLATED THERMOSTAT

FIELD OF THE INVENTION

The present subject matter relates generally to electric heating elements for appliances, such as for cooktop or range appliances.

BACKGROUND OF THE INVENTION

Cooking appliances that include a cooktop traditionally have at least one heating element (e.g., electric coil heating element) positioned on a panel proximate a cooktop surface for use in heating or cooking an object, such as a cooking utensil, and its contents. Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the utensil or cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known coil heating elements using bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip early.

As a result, it would be useful to have a cooktop appliance addressing one or more of the above identified issues. In particular, it may be advantageous to provide a cooktop appliance having a thermostat with one or more features for enhancing contact (e.g., with a utensil on a heating element) or conductive heat transfer from a utensil to a thermostat (e.g., without being unduly affected by radiative heat transfer from the heating element).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric resistance heating coil assembly is provided. The electric resistance heating coil assembly may include a spiral wound sheathed heating element, a shroud cover, a thermostat, and a heat transfer disk. The spiral wound sheathed heating element may have a first coil section and a second coil section. The shroud cover may be disposed radially inward from the first and second coil sections. The shroud cover may define an axial hole. The thermostat may be positioned within the axial hole and connected in series between the first and second coil sections of the spiral wound sheathed heating element. The thermostat may be spring loaded such that a distal end of the thermostat is urged away from a top surface of the spiral wound sheathed heating element. The heat transfer disk may be attached to the thermostat at the distal end of the thermostat. The shroud cover may define a continuous circumferential thermal break around the thermostat at the axial hole to prevent direct thermal conduction between the shroud cover and the thermostat.

In another exemplary aspect of the present disclosure, a cooktop appliance is provided. The cooktop appliance may include a heating element and a sensor support assembly. The heating element may define a heating zone. The sensor support assembly may be positioned within the heating zone of the heating element. The sensor support assembly may include a shroud cover, a thermostat, and a heat transfer disk. The shroud cover may define an axial hole. The thermostat may be positioned radially inward from the shroud cover. A continuous circumferential thermal break may be defined as a radial gap within the axial hole between the thermostat and the shroud cover. The heat transfer disk may be attached to the thermostat at the distal end of the thermostat and extend radially outward above the shroud cover.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
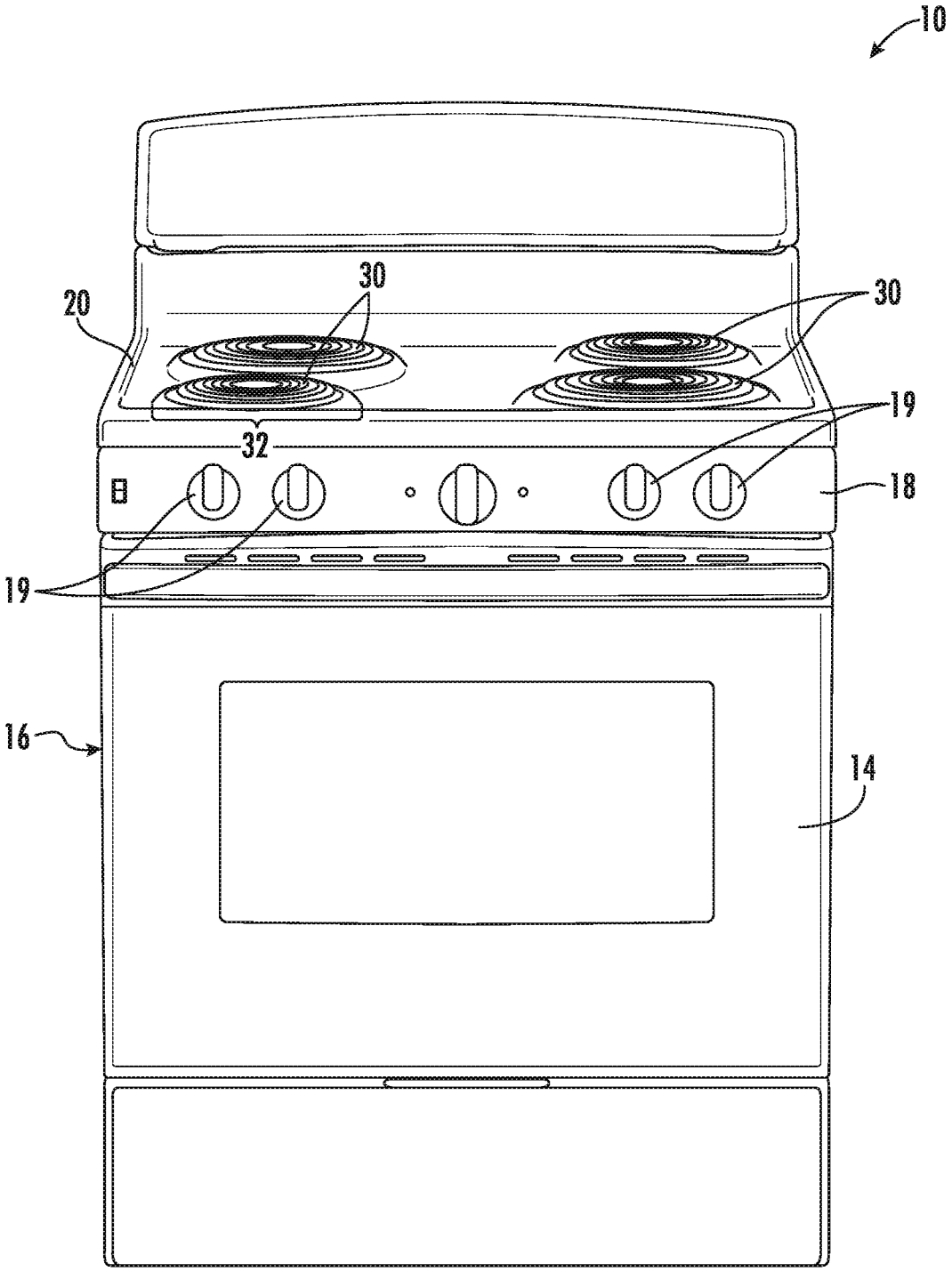
FIG. 1 provides a front perspective view of a range appliance according to exemplary embodiments of the present disclosure.
Figure 2:
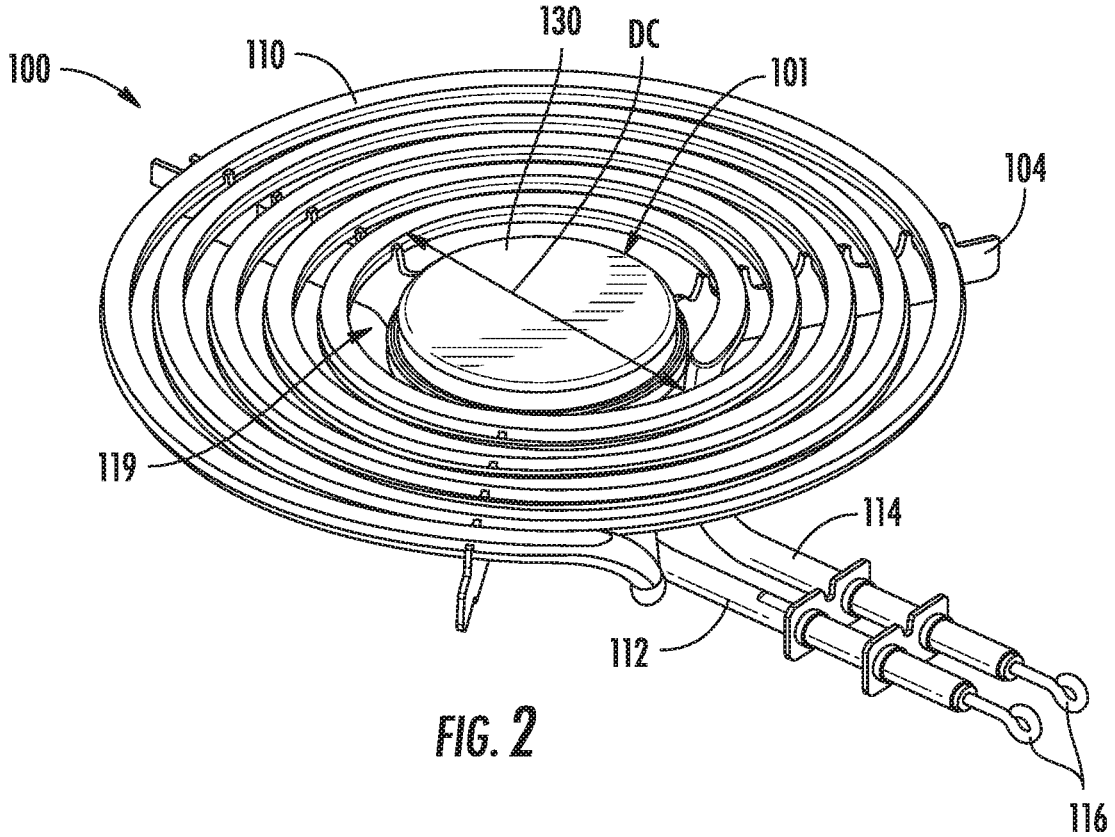
FIG. 2 provides a top perspective view of an electric resistance heating coil assembly of the exemplary range appliance of FIG. 1.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a front, perspective view of a range appliance 10 according to exemplary embodiments of the present disclosure. Range appliance 10 is provided by way of example only and is not intended to limit the present subject matter to the particular arrangement shown in FIG. 1. Thus, the present subject matter may be used with other cooktop appliance configurations (e.g., double oven range appliances, standalone cooktop appliances, etc.).

Generally, a top panel 20 of range appliance 10 includes one or more heating elements 30. Heating elements 30 may be, for example, electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

Generally, each heating element 30 defines a heating zone 32 on which a cooking utensil, such as a pot, pan, or the like, may be placed to cook or heat food items placed in the cooking utensil. In some embodiments, range appliance 10 also includes a door 14 that permits access to a cooking chamber 16 of range appliance 10 (e.g., for cooking or baking of food items therein). A control panel 18 having controls 19 permits a user to make selections for cooking of food items—although shown on a front panel of range appliance 10, control panel 18 may be positioned in any suitable location. Controls 19 may include buttons, knobs, and the like, as well as combinations thereof. As an example, a user may manipulate one or more controls 19 to select a temperature or a heat or power output for each heating element 30.

Figure 3:
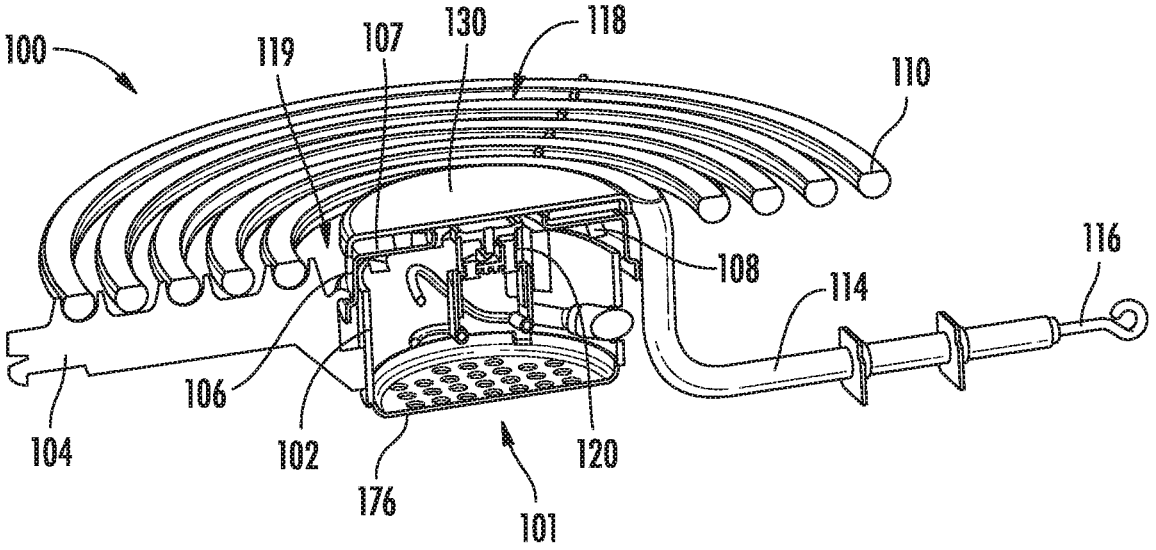
FIG. 3 provides a sectional perspective view of the exemplary electric resistance heating coil assembly of FIG. 2.
Figure 4:
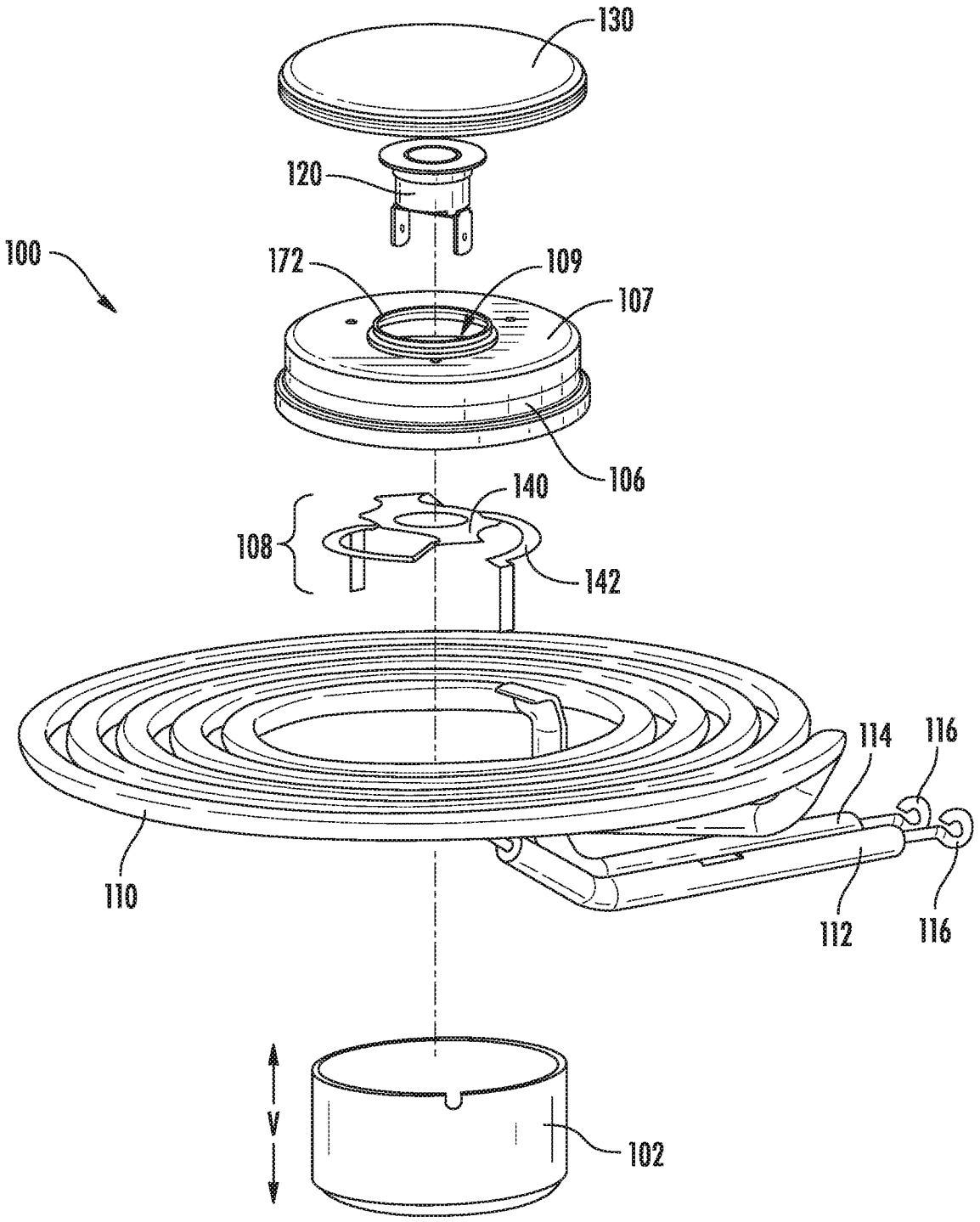
FIG. 4 provides an exploded perspective view of a portion of the exemplary heating coil assembly of FIG. 2.
Figure 5:
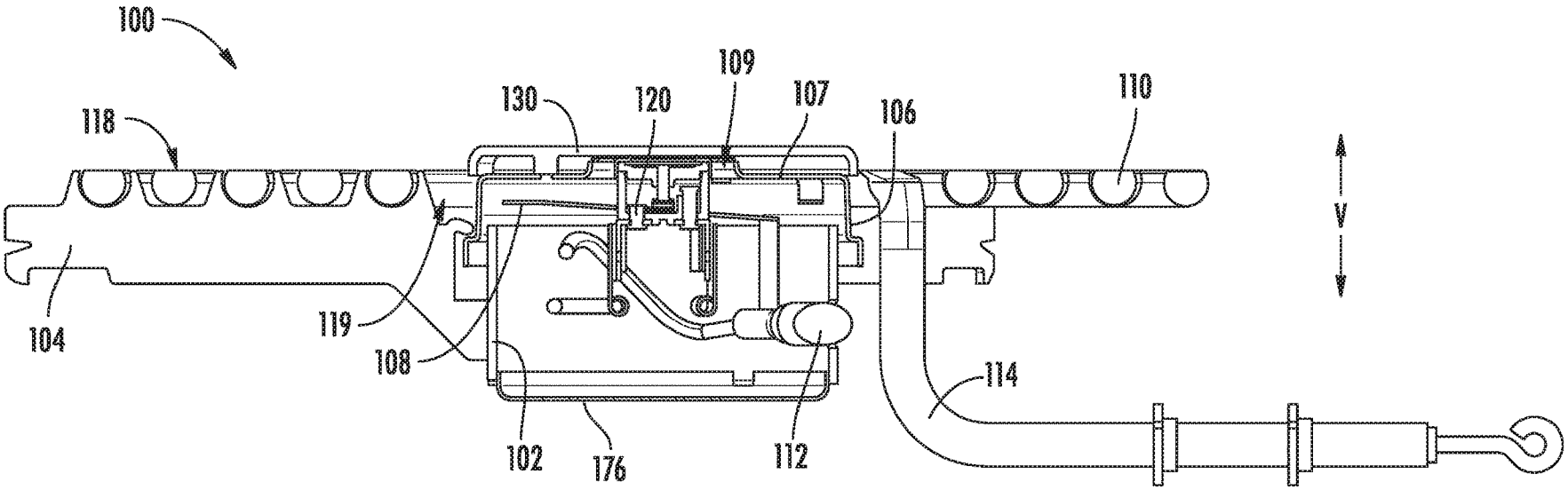
FIG. 5 provides a sectional elevation view of the exemplary electric resistance heating coil assembly of FIG. 2.

Turning now to FIGS. 2 through 5, FIG. 2 provides a top perspective view of an electric resistance heating coil assembly 100 of range appliance 10. FIGS. 3 and 5 provide sectional views of electric resistance heating coil assembly 100. FIG. 4 provides an exploded perspective view of a portion of electric resistance heating coil assembly 100. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a thermostat (e.g., bimetallic thermostat 120) and a utensil positioned on electric resistance heating coil assembly 100.

As shown, some embodiments of electric resistance heating coil assembly 100 include a spiral wound sheathed heating element 110. Spiral wound sheathed heating element 110 may include a first coil section 112 and a second coil section 114. In certain embodiments, spiral wound sheathed heating element 110 also has a pair of terminals 116. Each of first and second coil sections 112, 114 may be directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Within the heating zone 32, a sensor support assembly 101, including thermostat 120, is positioned. When assembled, bimetallic thermostat 120 is connected, for example, in series between first and second coil sections 112, 114 of spiral wound sheathed heating element 110. Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards a utensil (not shown) positioned on top surface 118 of spiral wound sheathed heating element 110. Bimetallic thermostat 120 may measure the temperature of the utensil on top surface 118 of spiral wound sheathed heating element 110 due to heat transfer between the utensil and bimetallic thermostat 120. As discussed in greater detail below, electric resistance heating coil assembly 100 includes features for facilitating conductive heat transfer between the utensil on top surface 118 of spiral wound sheathed heating element 110 and bimetallic thermostat 120.

Sensor support assembly 101 may also include a shroud 102 and coil support arms 104. Coil support arms 104 extend (e.g., radially) from shroud 102, and spiral wound sheathed heating element 110 is positioned on and supported by coil support arms 104. Coil support arms 104 may rest on top panel 20 to support electric resistance heating coil assembly 100 on top panel 20. A shroud cover 106 may be disposed radially inward from the first and second coil sections 112, 114. For instance, shroud cover 106 may define an axial opening 109 (e.g., along an axial direction or parallel to vertical direction V) and may be positioned on or above shroud 102. Additionally or alternatively, shroud cover 106 may extend over shroud 102. In particular, a top of shroud 102 may be nested in shroud cover 106.

As shown, shroud cover 106 may include a top wall 107 and a sidewall 111 that extends downward from top wall 107. In some embodiments, axial opening 109 is defined through top wall 107, such as at a center of shroud cover 106. Additionally or alternatively, sidewall 111 may extend circumferentially about top wall 107 (e.g., at an outer perimeter thereof). Optionally, a nesting rim may be disposed on sidewall 111 (e.g., therebelow) or extend circumferentially around sidewall 111 to rest on shroud 102 and prevent shroud cover 106 from moving (e.g., radially) relative to shroud 102.

When assembled, bimetallic thermostat 120 may be disposed within a portion of a shroud cover 106, as will be described in detail below. In particular, bimetallic thermostat 120 may extend through (e.g., "float") within axial opening 109 (i.e., radially inward from a perimeter of axial opening 109). Shroud cover 106 may be positioned below a top portion of thermostat 120 (e.g., distal end 122) and above a bottom portion of thermostat 120 (e.g., an interior end 123 opposite of distal end 122). During use, shroud 102, including shroud cover 106, generally shields bimetallic thermostat 120 from at least a portion of the heat generated at spiral wound sheathed heating element 110. Optionally, shroud 102, including shroud cover 106, is formed from a relatively low thermal conductivity metal (e.g., steel or a steel alloy).

Sensor support assembly 101 further includes a heat transfer disk 130. Heat transfer disk 130 is positioned on bimetallic thermostat 120 at distal end 122 of bimetallic thermostat 120. For example, heat transfer disk 130 may contact distal end 122. Thus, heat transfer disk 130 may be in direct, thermal, conductive communication with bimetallic thermostat 120. Because heat transfer disk 130 is positioned at distal end 122, heat transfer disk 130 may also be urged away from top surface 118 of spiral wound sheathed heating element 110.

In certain embodiments, heat transfer disk 130 is attached to thermostat 120. Specifically, heat transfer disk 130 may be attached (e.g., directly) to thermostat 120 at distal end 122. For instance, bimetallic thermostat 120 can be welded, clipped, or otherwise attached to a bottom surface 133 of heat transfer disk 130 with mechanical fasteners (e.g., screws, rivets, mated threading, etc.), or a combination thereof. Along with being attached to thermostat 120, heat transfer disk 130 may be supported on shroud cover 106 (e.g., apart from top cap 126 or support flange 128). For instance, one or more support stakes 170 may extend downward from a bottom surface 133 of heat transfer disk 130 to directly rest on or join to shroud cover 106 (e.g., radially outward from bimetallic thermostat 120). The support stakes 170, or heat transfer disk 130 generally may be joined (e.g., via one or more rivets, screws, or other suitable mechanical fasteners) to top wall 107 of shroud cover 106.

Heat transfer disk 130 or bimetallic thermostat 120 may be positioned concentrically with a center 119 of spiral wound sheathed heating element 110. Center 119 of spiral wound sheathed heating element 110 may be open, and spiral wound sheathed heating element 110 may extend circumferentially around heat transfer disk 130 or bimetallic thermostat 120 at center 119. Heat transfer disk 130 may also cover distal end 122 of bimetallic thermostat 120. In some embodiments, heat transfer disk 130 extends above and over at least a portion of shroud 102, including shroud cover 106.

When assembled, heat transfer disk 130 may be positioned between bimetallic thermostat 120 and a utensil on top surface 118 of spiral wound sheathed heating element 110, and heat transfer disk 130 may contact the utensil (e.g., at a top contact surface 131 of heat transfer disk 130). Heat transfer disk 130 may also include a flange 132 that extends downwardly from contact surface 131 towards shroud cover 106. During use, heat transfer disk 130 may be urged against the utensil on top surface 118 of spiral wound sheathed heating element 110 (e.g., due to the spring loading of bimetallic thermostat 120).

In some embodiments, a spring bracket 108 biases shroud cover 106 (and thus heat transfer disk 130 and thermostat 120) upwardly. As shown, spring bracket 108 may include a mounting plate 140 and one or more biasing arms 142 extending therefrom. When assembled, shroud cover 106 is supported on or attached to mounting plate 140. For instance, shroud cover 106 may rest directly on mounting plate 140. Biasing arms 142 may be resilient members, which generally urge mounting plate 140 upward. Spring bracket 108, including biasing arms 142, may be formed from any suitable high yield strength material. For instance, spring bracket 108 is formed of a stainless steel, full hard, or spring tempered material. Spring bracket 108 can be formed of other suitable high yield strength materials as well.

Figure 6:
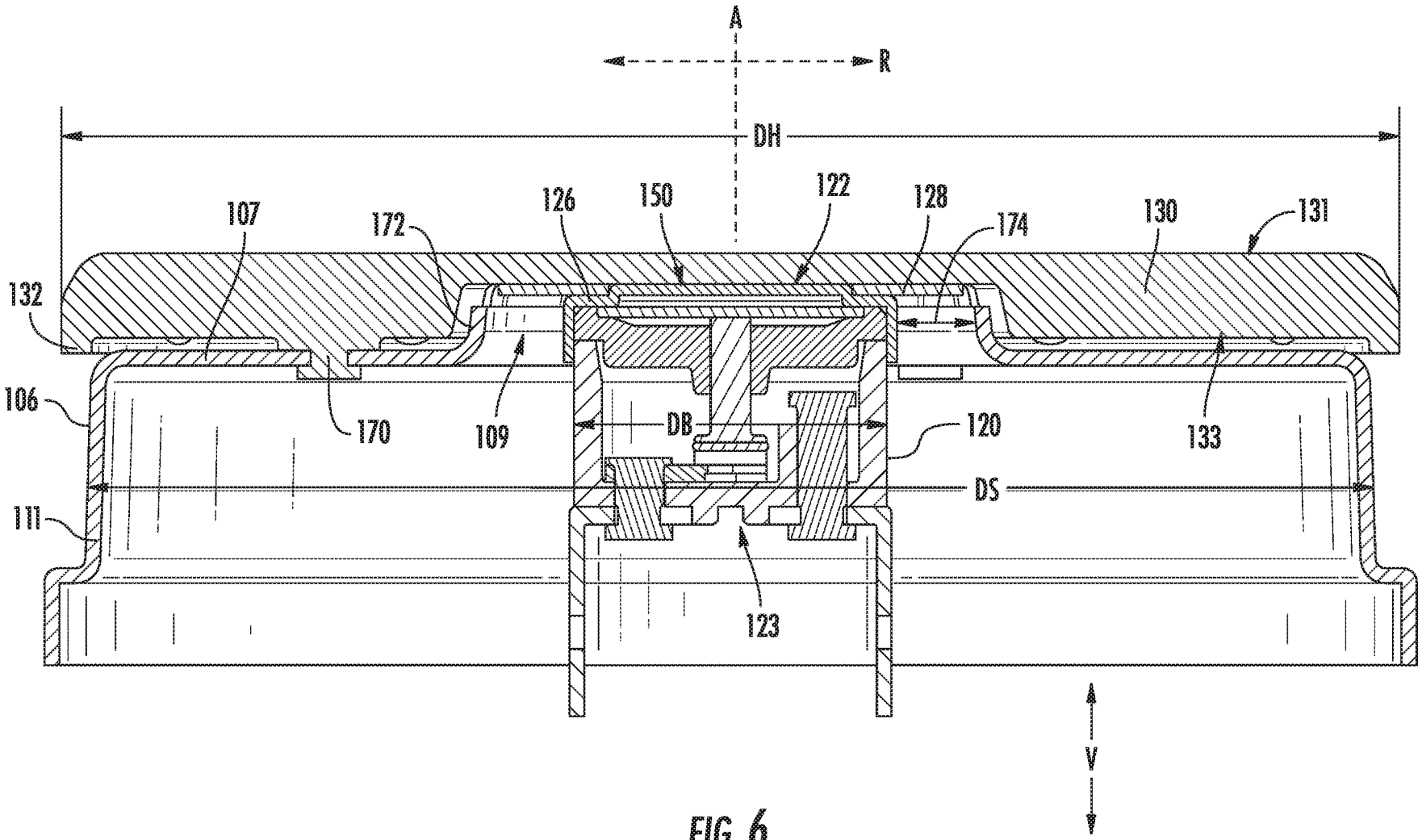
FIG. 6 provides a sectional elevation view of a portion of the exemplary electric resistance heating coil assembly of FIG. 2.
Figure 7:
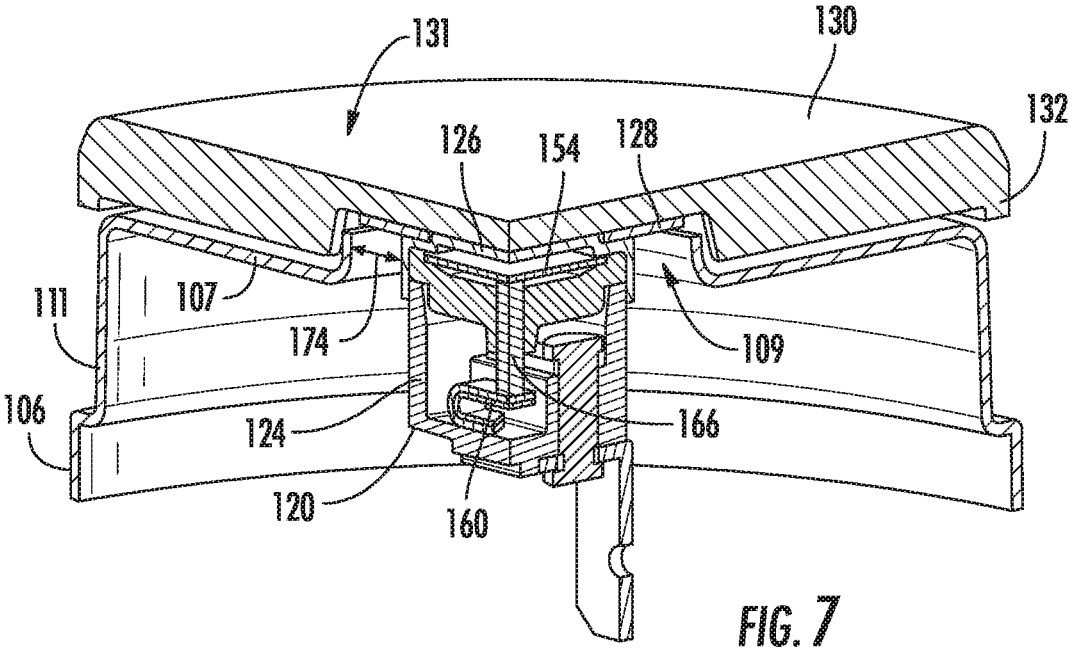
FIG. 7 provides a bi-sectional perspective view of a portion of the exemplary electric resistance heating coil assembly of FIG. 2.
Figure 8:
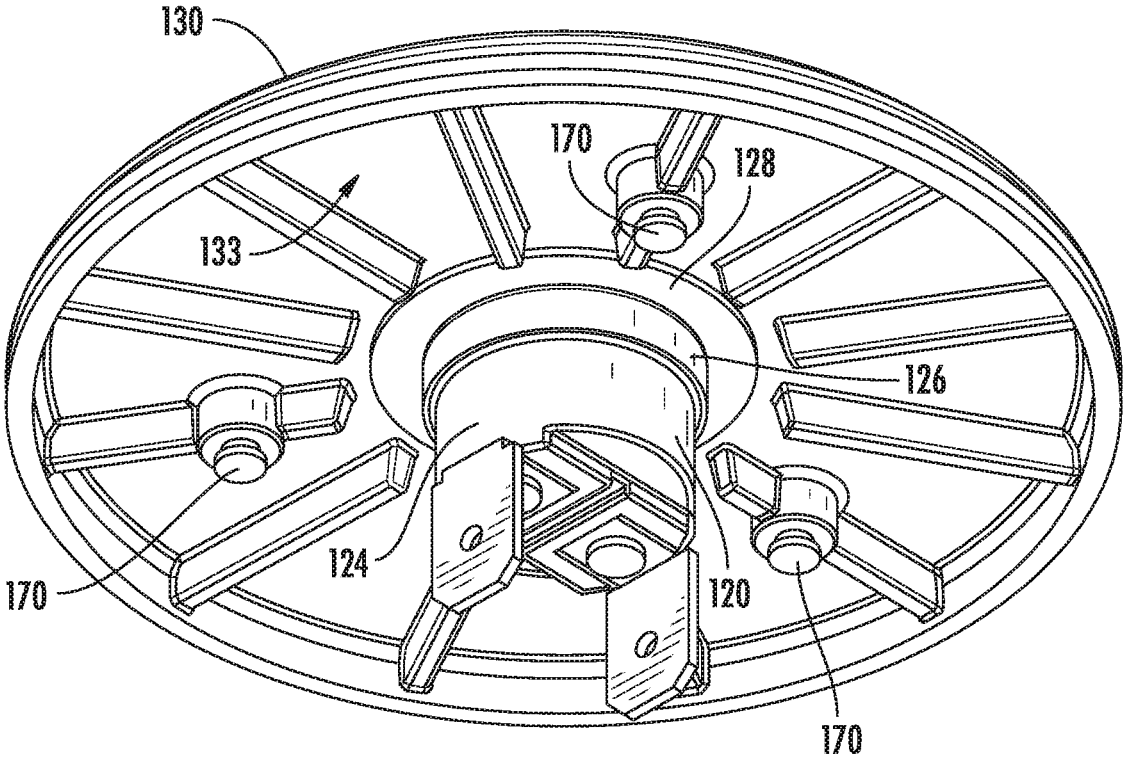
FIG. 8 provides a bottom perspective view of the thermostat and heat transfer disk of the exemplary electric resistance heating coil assembly of FIG. 2.
Figure 9:
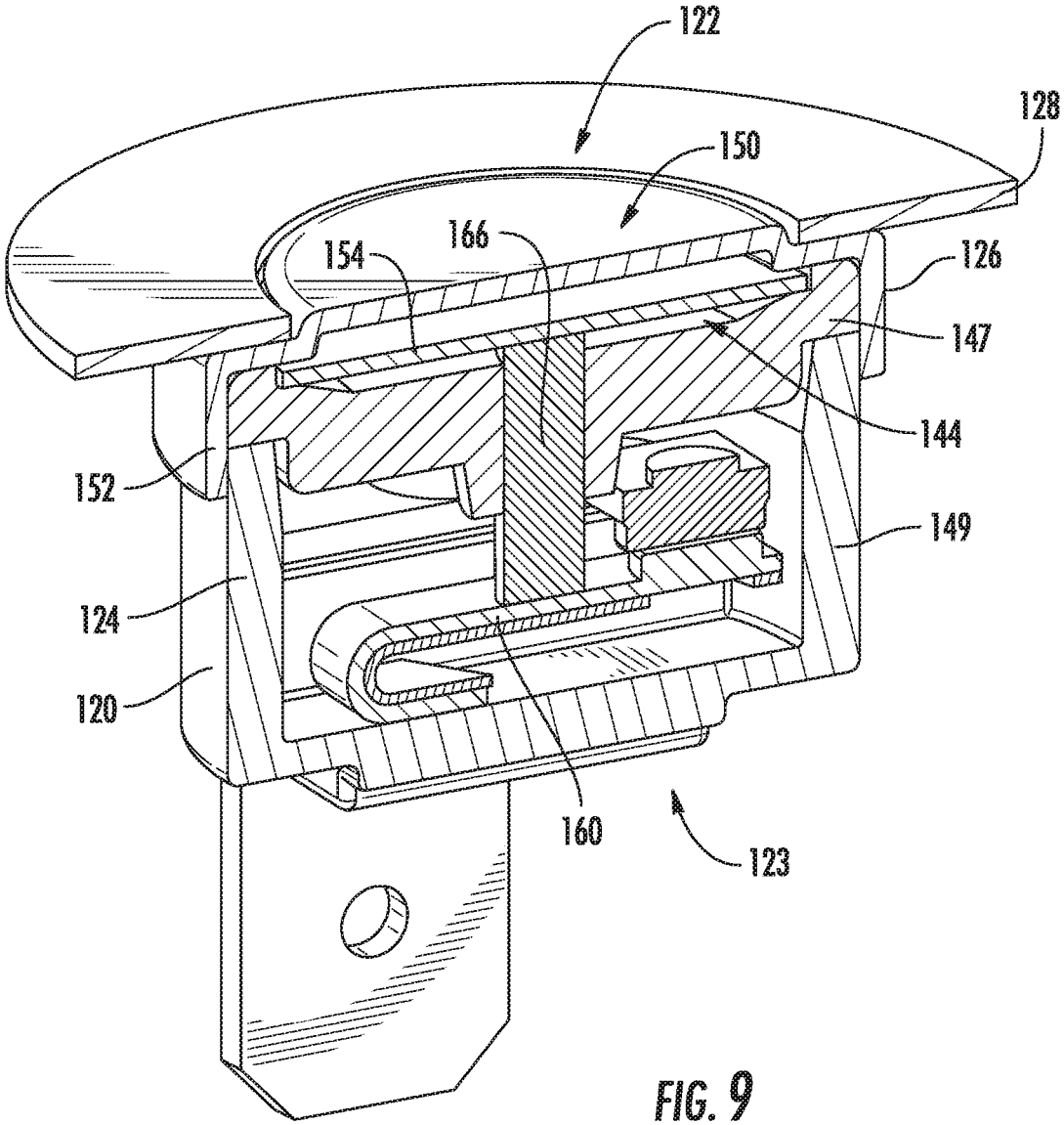
FIG. 9 provides a sectional perspective view of the thermostat of the exemplary electric resistance heating coil assembly of FIG. 2.

Turning now to FIGS. 6 through 9, various portions of heating assembly 100 are illustrated apart from the heating coil sections 112, 114. In particular, FIGS. 6 through 8 provide views of shroud cover 106, bimetallic thermostat 120, and heat transfer disk 130. FIG. 9 provides a sectional perspective view of bimetallic thermostat 120, alone.

As shown, bimetallic thermostat 120 includes a discrete base 124 and top cap 126 that is held on base 124. For instance, at least a portion of top cap 126 may extend above base 124 and define an uppermost surface of bimetallic thermostat 120 at distal end 122. In some embodiments, base 124 and top cap 126 are formed of, or include, distinct materials. For instance, base 124 may be formed from or include a substrate material, such as a thermally insulating or heat-resistant material (e.g., ceramic), while top cap 126 is formed from or includes a second material, such as a relatively high thermal conductivity metal (e.g., aluminum, copper, a copper alloy, or an aluminum alloy). Top cap 126 may thus absorb and conduct heat faster or more readily than base 124. Optionally, a support flange 128 may be provided on top cap 126 at distal end 122 (e.g., as an integral or, alternatively, discrete element joined to top cap 126). For instance, support flange 128 may extend radially outward from top cap 126 (e.g., against the bottom surface 133 of heat transfer disk 130). Additionally or alternatively, support flange 128 may be formed from or include the same material as top cap 126.

As noted above, heat transfer disk 130 may be attached to thermostat 120 (e.g., at top cap 126 or support flange). In some such embodiments, heat transfer disk 130 is mounted to thermostat 120 (e.g., via welding or a suitable mechanical fastener, such as a screw or rivet). Optionally, heat transfer disk 130 may be friction welded, spot welded, seam welded, ultrasonic welded, or resistance welded to support flange 128 (e.g., to provide direct thermal conductive communication between bimetallic thermostat 120 and heat transfer disk 130).

Generally, heat transfer disk 130 may be formed from or include a relatively high thermal conductivity metal. For instance, heat transfer disk 130 may be formed or include of aluminum, copper, a copper alloy, or an aluminum alloy. Such materials advantageously facilitate conductive heat transfer between the utensil on top surface 118 (FIG. 5) of spiral wound sheathed heating element 110 (FIG. 5) and heat transfer disk 130. In certain embodiments, heat transfer disk 130 and a portion of thermostat 120 (e.g., support flange 128 or top cap 126) may be formed from or include a common material, such as one of aluminum, copper, a copper alloy, or an aluminum alloy, in order to advantageously facilitate conductive heat transfer between bimetallic thermostat 120 and heat transfer disk 130, and facilitate the joining of heat transfer disk 130 to thermostat 120.

Heat transfer disk 130 may be sized to facilitate conductive heat transfer between a utensil on top surface 118 of spiral wound sheathed heating element 110 and bimetallic thermostat 120. For example, a diameter DH of heat transfer disk 130 (e.g., maximum radial diameter at contact surface 131 or flange 132) may be larger than a diameter DB defined by bimetallic thermostat 120 (e.g., maximum radial diameter at the top cap 126 or base 124). For instance, DH may be no less than two times greater than DB in a radial plane or plane that is perpendicular to the vertical direction V). Additionally or alternatively, the diameter DH of heat transfer disk 130 may be less than a diameter DC (FIG. 2) of center 119 of spiral wound sheathed heating element 110. Further additionally or alternatively, diameter DH of heat transfer disk 130 may be greater than a diameter DS of shroud cover 106 (e.g., a maximum diameter at top wall 107 or sidewall 111). Thus, the diameter DH may located be radially outward, for instance from top wall 107 and at least a portion of sidewall 111. During use, liquids (e.g., spilled) on top of heat transfer disk 130 may be directed around shroud cover 106 and prevented from passing through axial opening 109. Optionally, a raised rim 172 may extend upward about axial opening 109, as shown, to further prevent the passage of liquids through axial opening 109.

The sizing of heat transfer disk 130 relative to bimetallic thermostat 120 or shroud cover 106 may advantageously assist conductive heat transfer from the utensil on top surface 118 of spiral wound sheathed heating element 110 to bimetallic thermostat 120.

As noted above, bimetallic thermostat 120 may be positioned radially inward from the shroud cover 106. Specifically, bimetallic thermostat 120 may be held by heat transfer disk 130 within axial opening 109. When assembled, the shroud cover 106 defines a continuous circumferential thermal break 174 at axial opening 109 around the thermostat 120. For instance, along the radial direction R, continuous circumferential thermal break 174 may be an uninterrupted radial gap defined between the inner edge or perimeter of axial opening 109 and bimetallic thermostat 120. Moreover, bimetallic thermostat 120 may appear to float within axial opening 109 without directly contacting shroud cover 106.

During operation of spiral wound sheathed heating element 110 (FIG. 5), shroud cover 106 may increase in temperature. Nonetheless, thermal break 174 may prevent heat transfer between bimetallic thermostat 120 and shroud cover 106. In turn, thermal break 174 may improve performance of bimetallic thermostat 120. In particular, bimetallic thermostat 120 more accurately measures or senses the temperature of a utensil on top surface 118 (FIG. 5) of spiral wound sheathed heating element 110 by reducing heat transfer from spiral wound sheathed heating element 110 to bimetallic thermostat 120 compared to known heating elements.

As shown, thermal break 174 may be unobstructed, extending through shroud cover 106 with axial opening 109. Thus, air may be flowable or pass through shroud cover 106 via thermal break 174. For instance, air may flow upwardly from below electric resistance heating coil assembly 100 (FIG. 3) and enter shroud 102 through a perforated plate 176 (FIG. 3). Such upwardly flowing air may pass through shroud 102 to shroud cover 106 and then pass through shroud cover 106 at thermal break 174. Such air flow may thus cool bimetallic thermostat 120 and assist with limiting heat transfer between bimetallic thermostat 120 and shroud cover 106 (e.g., and other components of electric resistance heating coil assembly 100). Additionally or alternatively, electric resistance heating coil assembly 100 may reduce a maximum temperature of internal electrical contacts of bimetallic thermostat 120, which allows for lower cost materials to be used within bimetallic thermostat 120. In addition, bimetallic thermostat 120 has a reduced cycle time after tripping compared to known sensor arrangements due to the cooling air flow through thermal break 174.

Turning especially to FIG. 9, top cap 126 may be seated on top of or over base 124. In some embodiments, top cap 126 is press fitted on top of base 124. Optionally, top cap 126 may cover multiple segments of base 124, such as an upper frame 147 and a lower frame 149.

In some embodiments, top cap 126 includes an upper surface 150 that extends across base 124 and a cap wall 152 that extends downwardly from upper surface 150 around base 124. Optionally, base 124 may define a central opening 144 (e.g., within which a bimetallic disk 154 is disposed). Thus, the upper surface 150 of top cap 126 may extend across and close central opening 144 while cap wall 152 contacts base 124, holding upper surface 150 in place.

Within base 124, bimetallic disk 154 may be mounted or otherwise positioned proximal to the distal end 122 or top cap 126. As shown, a conductive spring 160 may be disposed further disposed within base 124 and in biased engagement with bimetallic disk 154. For instance, conductive spring 160 may be mounted below bimetallic disk 154 (e.g., proximal to interior end 123). Conductive spring 160 may generally positioned between the interior end 123 and bimetallic disk 154. Optionally, conductive spring 160 is held within lower frame 149. Additionally or alternatively, conductive spring 160 may be positioned below upper frame 147 while bimetallic disk 154 is positioned above at least a portion of upper frame 147 (e.g., such that upper frame 147 insulates conductive spring 160 from bimetallic disk 154 or central opening 144). Further additionally or alternatively, a support rod 166 may extend (e.g., axially) between conductive spring 160 (e.g., at a top lever) and bimetallic disk 154. For instance, support rod 166 may extend through an axial channel in base 124 (e.g., defined through upper frame 147) such that movement or biasing forces are transferred from conductive spring 160 to bimetallic disk 154 (and vice versa). When assembled, conductive spring 160 may be in biased engagement with bimetallic disk 154 to motivate the bimetallic disk 154 towards the first end 162 within the base 124. In the illustrated embodiments, conductive spring 160 is formed as a cantilever spring having a pair of support levers connected by an integral fulcrum joint.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a shroud cover disposed radially inward from the first and second coil sections, the shroud cover defining an axial hole;

a thermostat positioned within the axial hole and connected in series between the first and second coil sections of the spiral wound sheathed heating element, the thermostat spring loaded such that a distal end of the thermostat is urged away from a top surface of the spiral wound sheathed heating element; and a heat transfer disk attached to the thermostat at the distal end of the thermostat, wherein the shroud cover defines a continuous circumferential thermal break around the thermostat at the axial hole to prevent direct thermal conduction between the shroud cover and the thermostat, and wherein the thermostat comprises a base defining a central opening and a top cap extending across and closing the base.

2. The electric resistance heating coil assembly of claim 1, wherein the heat transfer disk is supported on the shroud cover.

3. The electric resistance heating coil assembly of claim 1, wherein a diameter of the heat transfer disk is greater than a diameter of the thermostat, and wherein the diameter of the heat transfer disk is less than a diameter of a center of the spiral wound sheathed heating element.

4. The electric resistance heating coil assembly of claim 3, wherein the shroud cover comprises a top wall defining the axial hole and a sidewall extending downward from the top wall, wherein the diameter of the heat transfer disk is greater than a diameter of the sidewall of the shroud cover.

5. The electric resistance heating coil assembly of claim 1, wherein the distal end of the thermostat is held above the shroud cover.

6. The electric resistance heating coil assembly of claim 1, further comprising a spring bracket mounted to the shroud cover below the distal end of the thermostat.

7. The electric resistance heating coil assembly of claim 1, wherein the top cap is disposed against the heat transfer disk at the distal end, wherein the shroud cover comprises a first material, and wherein the top cap comprises a second material distinct from the first material.

8. The electric resistance heating coil assembly of claim 7, wherein the heat transfer disk comprises the second material.

9. The electric resistance heating coil assembly of claim 7, wherein the second material is aluminum, copper, a copper alloy, or an aluminum alloy.

10. The electric resistance heating coil assembly of claim 7, wherein the heat transfer disk is formed of aluminum, copper, a copper alloy, or an aluminum alloy.

11. A cooktop appliance, comprising:

a heating element defining a heating zone; and a sensor support assembly positioned within the heating zone of the heating element, the sensor support assembly comprising a shroud cover defining an axial hole, a thermostat positioned radially inward from the shroud cover, a continuous circumferential thermal break being defined as a radial gap within the axial hole between the thermostat and the shroud cover, and a heat transfer disk attached to the thermostat at a distal end of the thermostat and extending radially outward above the shroud cover, and wherein the thermostat comprises a base defining a central opening and a top cap extending across and closing the base.

12. The cooktop appliance of claim 11, wherein the heat transfer disk is supported on the shroud cover.

13. The cooktop appliance of claim 11, further comprising a spiral wound sheathed heating element having a first coil section and a second coil section disposed radially outward from the shroud cover, wherein a diameter of the heat transfer disk is greater than a diameter of the thermostat, and wherein the diameter of the heat transfer disk is less than a diameter of a center of the spiral wound sheathed heating element.

14. The cooktop appliance of claim 13, wherein the shroud cover comprises a top wall defining the axial hole and a sidewall extending downward from the top wall, wherein the diameter of the heat transfer disk is greater than a diameter of the top wall of the shroud cover.

15. The cooktop appliance of claim 11, wherein the distal end of the thermostat is held above the shroud cover.

16. The cooktop appliance of claim 11, further comprising a spring bracket mounted to the shroud cover below the distal end of the thermostat.

17. The cooktop appliance of claim 11, wherein the top cap is disposed against the heat transfer disk at the distal end, wherein the shroud cover comprises a first material, and wherein the top cap comprises a second material distinct from the first material.

18. The cooktop appliance of claim 17, wherein the heat transfer disk comprises the second material.

19. The cooktop appliance of claim 17, wherein the second material is aluminum, copper, a copper alloy, or an aluminum alloy.

20. The cooktop appliance of claim 17, wherein the heat transfer disk is formed of aluminum, copper, a copper alloy, or an aluminum alloy.

* * * * *